US007036341B2

(12) United States Patent
Shibuta et al.

(10) Patent No.: US 7,036,341 B2
(45) Date of Patent: May 2, 2006

(54) TRANSFER JACK AND WEFT KNITTING MACHINE HAVING THE SAME, AND STITCH TRANSFER METHOD USING TRANSFER JACK

(75) Inventors: Takekazu Shibuta, Wakayama (JP); Yoshinori Shimasaki, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/514,318

(22) PCT Filed: May 14, 2003

(86) PCT No.: PCT/JP03/06036

§ 371 (c)(1),
(2), (4) Date: Nov. 15, 2004

(87) PCT Pub. No.: WO03/097915

PCT Pub. Date: Nov. 27, 2003

(65) Prior Publication Data

US 2005/0241343 A1 Nov. 3, 2005

(30) Foreign Application Priority Data

May 15, 2002 (JP) ..... 2002-140108

(51) Int. Cl.
*D04B 15/04* (2006.01)

(52) U.S. Cl. ..... 66/96 R

(58) Field of Classification Search ..... 66/90, 66/95, 96 R, 96 W, 104, 109
See application file for complete search history.

(56) References Cited

U.S. PATENT DOCUMENTS

| | | | | |
|---|---|---|---|---|
| 3,315,495 | A * | 4/1967 | Kuhnert | 66/96 R |
| 4,646,542 | A * | 3/1987 | Tenconi | 66/24 |
| 5,423,204 | A * | 6/1995 | Shima et al. | 66/109 |
| 5,992,184 | A * | 11/1999 | Shibuta | 66/64 |
| 6,047,561 | A * | 4/2000 | Gary et al. | 62/624 |
| 6,079,231 | A * | 6/2000 | Shima | 66/64 |

FOREIGN PATENT DOCUMENTS

| | | |
|---|---|---|
| JP | 11-323703 | 11/1999 |
| JP | 2001-214351 | 8/2001 |
| WO | 01/86048 | 11/2001 |

* cited by examiner

*Primary Examiner*—Danny Worrell
(74) *Attorney, Agent, or Firm*—Wenderoth, Lind & Ponack, L.L.P.

(57) ABSTRACT

A position to form a stitch loop hooking portion is biased toward a base portion of a transfer jack from a center of a gap between needle beds. Therefore, the effective width of a tip portion of the transfer jack with respect to a height of a hook portion of a knitting needle is increased when the knitting needle enters into the stitch loop from a direction of the base portion of the transfer jack.

7 Claims, 10 Drawing Sheets

TRANSFER JACK AND WEFT KNITTING MACHINE HAVING THE SAME, AND STITCH TRANSFER METHOD USING TRANSFER JACK

TECHNICAL FIELD

The present invention relates to a transfer jack capable of inserting a knitting needle into a stitch loop when executing a stitch transfer from an upper auxiliary bed to a lower needle bed, in a flat knitting machine provided with at least a pair of needle beds installed in a front to back direction, and accommodating therein knitting needles disposed so as to slide in a back and forth direction. The upper auxiliary bed on which the transfer jack for a stitch transfer is mounted is located above the needle beds. The invention also relates to a knitting machine provided with such a transfer jack and an associated method of a stitch transfer.

BACKGROUND ART

A conventional flat knitting machine is provided with a pair of needle beds installed in a front to back direction so as to confront each other, holding knitting needles in needle grooves formed on an upper face thereof so as to allow a back and forth movement of the knitting needles, and a transfer jack bed including a stitch transfer mechanism consisting of a transfer jack and so on, located above at least one of the needle beds. The machine is used to perform a stitch transfer by transferring the stitch loop on a knitting needle on the needle bed to a stitch loop hooking portion of the transfer jack on the transfer jack bed, racking the front and rear needle beds such that a longitudinal phase thereof becomes different from each other, and then transferring the stitch loop hooked on the transfer jack to the knitting needle on the needle bed.

In such a conventional flat knitting machine, as shown in FIG. 10, the transfer jack 102 is designed such that the stitch loop hooking portion 108 formed on an upper face thereof for receiving a stitch loop from the knitting needles 104*a* and 104*b* is aligned with a center line X—X between the front and rear needle beds 101*a* and 101*b*, when the transfer jack 102 advances to the racking position.

Regarding a height of the stitch loop hooking portion 108, it is desirable to locate the hooking portion at a sufficiently low position to avoid applying an excessive tension to the stitch loop 106 engaged on the stitch loop hooking portion 108.

Also, in a knitting machine of this type, a relief portion 102*b* is formed on a bottom portion 102*a* of the stitch loop hooking portion 108 and the transfer jack 102, to avoid interference with a sinker plate 107.

Accordingly, since a distance a has to be reduced because of such a restriction on a forming location of the bottom portion 102*a* of the transfer jack 102, an effective width c of a tip portion of the transfer jack 102, with respect to a width b of a hook portion 109 of the knitting needle 104*a* set to move in a direction 109 from a base portion toward the tip portion of the transfer jack 102 so as to pass through the stitch loop 106, also has to be reduced. This reduction often leads to a problem that the hook portion 109 of the knitting needle 104*a* moving forward pushes the stitch loop 106 toward the tip portion, and hence the stitch loop cannot be caught by the hook portion 109 or falls off when transferring the stitch loop from the transfer jack 102 to the knitting needle 104*a* located thereunder.

To cope with such a problem, the present applicant has formerly proposed a method of stitch transfer, as disclosed in Japanese Published Unexamined Patent Application No. H11-323703 and IP Laid Open WO01/86048. In the Japanese Published Unexamined Patent Application No. H11-323703, a condition for the stitch transfer from a transfer jack to a knitting needle is improved by virtually increasing an effective width C of a tip portion of the transfer jack, through a back and forth motion of the transfer jack to be made when transferring a stitch loop engaged on the transfer jack to the knitting needle on a needle bed, such as moving the transfer jack in such a direction that the stitch loop moves toward a rear face of a hook portion of the knitting needle when the rear face portion of the hook portion of the knitting needle enters into the stitch loop, and then moving the transfer jack in such a direction that the stitch loop moves toward a front face of the hook portion when the hook front face portion of the knitting needle enters into the stitch loop. In the IPO Laid Open WO01/86048, the effective width C of a tip portion of the transfer jack is virtually increased by moving the transfer jack up and down when the knitting needle enters into the stitch loop.

SUMMARY OF THE INVENTION

It is an object of the present invention to provide a transfer jack capable of improving a condition for performing a stitch transfer, by minimizing the problem incidental to a conventional transfer jack observed in a stitch transfer process from a transfer jack to a knitting needle.

It is another object of the present invention to provide a flat knitting machine provided with such a transfer jack. It is still another object to provide a method of stitch transfer utilizing the transfer jack according to the present invention.

For achieving the foregoing object, the present invention provides a transfer jack, comprising a stitch loop hooking portion which engages with a stitch loop, formed on an upper face of a tip portion of a main body thereof; a stitch loop stopper formed so as to backwardly extend from the stitch loop hooking portion; and a relief portion formed on a lower face of the main body in the proximity of the stitch loop hooking portion, for avoiding interference between the transfer jack located at an advanced position and a sinker plate disposed at a foremost portion of a front needle bed and a rear needle bed during a racking motion. A forming position of the stitch loop hooking portion of the transfer jack is biased toward a base portion of the transfer jack from a center of a gap between the front needle bed and the rear needle bed, with respect to the advanced position of the transfer jack during the racking motion. A flat bottom portion between the relief portions 2*a* and 2*b* formed on the lower face of the transfer jack is set in the gap between the front and rear needle beds which is a position where interference with the sinker plate can be avoided, so as to increase an effective width corresponding to a distance between the stitch loop hooking portion and a tip portion of the relief portion of the transfer jack, with respect to a height of a hook portion of the knitting needle when the knitting needle enters into the stitch loop from a direction of the base portion of the transfer jack.

Preferably, the transfer jack may further comprise a stitch loop retaining portion formed on a lower face thereof opposite to the stitch loop hooking portion. The retaining portion keeps the stitch loop from moving so as to prevent the stitch loop hooked on the stitch loop hooking portion from slipping toward the main body along the relief portion, and the stitch loop stopper may include a guide portion projecting toward a center of a trick gap for facilitating the stitch loop to be caught by the hook portion of the knitting needle when transferring the stitch loop from the transfer jack to the knitting needle on the needle bed.

Also, a flat knitting machine provided with the foregoing transfer jack is included in the scope of the present invention.

Further, the present invention provides a method of stitch transfer utilizing a transfer jack provided with a stitch loop hooking portion formed on an upper face of a tip portion of a main body thereof, a stitch loop stopper formed so as to backwardly extend from the stitch loop hooking portion, and a relief portion formed on a lower face of the main body in the proximity of the stitch loop hooking portion, for avoiding interference between the transfer jack located at an advanced position and a sinker plate disposed at a foremost portion of a front needle bed and a rear needle bed during a racking motion. The stitch loop hooking portion is formed on the transfer jack at a position biased toward a base portion of the transfer jack from a center of a gap between the front needle bed and the rear needle bed, with respect to the advanced position of the transfer jack during the racking motion, where a flat bottom portion between the relief portions formed on the lower face of the transfer jack is set in the gap between the front and rear needle beds which is a position where interference with the sinker plate can be avoided, so as to increase an effective width corresponding to a distance between the stitch loop hooking portion and a tip portion of the relief portion of the transfer jack, with respect to a height of a hook portion of the knitting needle. The method includes hooking the stitch loop on the stitch loop hooking portion from a knitting needle on either of the front needle bed or the rear needle bed, with the transfer jack located at the racking position; allowing the hook portion of the knitting needle to enter into the stitch loop through the increased effective width when the knitting needle is to enter into the stitch loop from a direction of the base portion of the transfer jack; stopping a movement of the stitch loop caused by the advancing knitting needle by the stitch loop stopper when the knitting needle is to enter into the stitch loop from a direction of the tip portion of the transfer jack; and passing the knitting needle through inside the stitch loop so as to engage the stitch loop with the hook portion of the knitting needle.

DETAILED DESCRIPTION OF THE INVENTION

Referring to the accompanying drawings, a transfer jack, a flat knitting machine provided with the transfer jack and a method of stitch transfer utilizing the transfer jack will be described in detail hereunder.

EMBODIMENT 1

Figure 1:
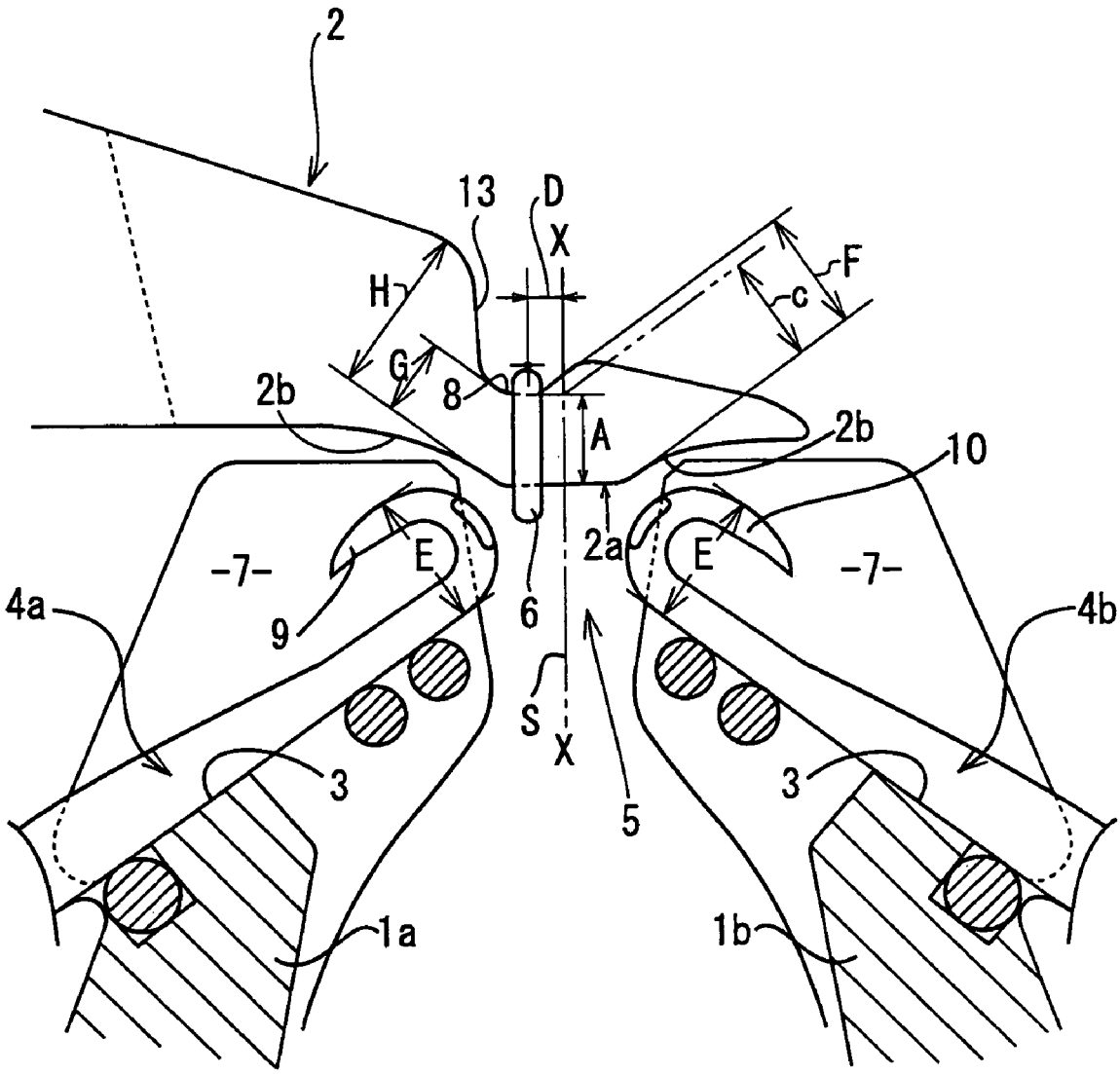
FIG. 1 is an enlarged fragmentary cross-sectional view showing a transfer jack according to Embodiment 1.
Figure 2A:
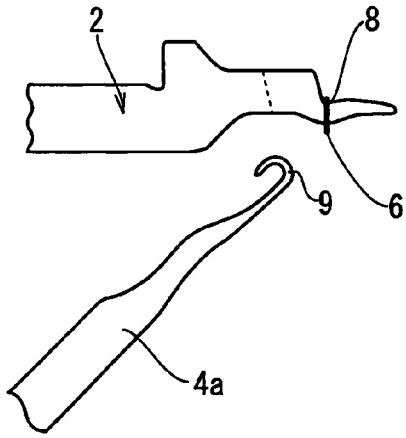
FIGS. 2(*a*) to 2(*e*) are schematic side views showing a stitch transfer process from the transfer jack of Embodiment 1 to a knitting needle of a front needle bed.
Figure 2B:
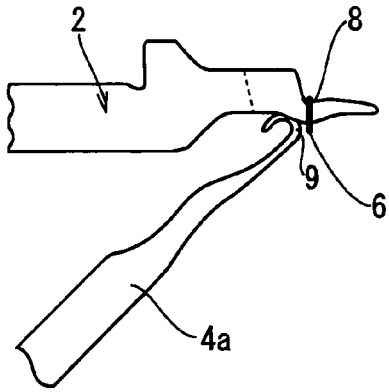
Figure 2C:
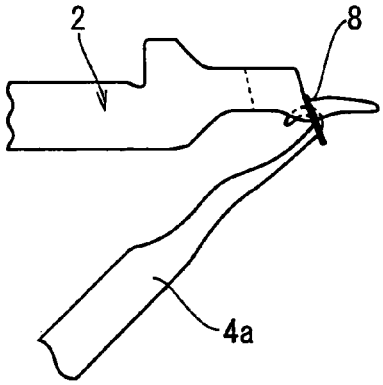
Figure 2D:
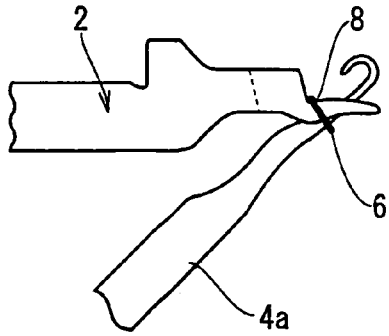
Figure 2E:
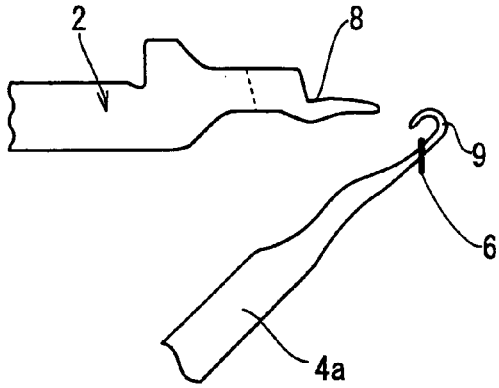

FIG. 1 is a side view showing an outline of a composition between needle beds of a flat knitting machine according to the present invention, which is provided with a pair of lower needle beds 1*a* and 1*b* disposed so as to confront each other in a front to back direction, and a transfer jack 2 serving as a stitch transferring tool accommodated in a transfer jack bed (not shown) located above the front lower needle bed 1*a* (hereinafter referred to as "front bed 1*a*").

The lower needle beds 1*a* and 1*b* are provided with a plurality of needle grooves 3 formed at regular intervals, and knitting needles 4*a* and 4*b* are movably held by the respective needle grooves 3 so as to move back and forth toward a trick gap 5 between the front and rear needle beds 1*a* and 1*b*.

In this embodiment, when the transfer jack 2 is moved to an advanced position for receiving and delivering a stitch loop 6 from and to the knitting needle 4*a* and 4*b* of the lower needle beds 1*a* and 1*b* as shown in FIG. 1 (a center line X—X of a gap between the needle beds 1*a* and 1*b*), such a position will be defined as a reference position S.

Also, when the transfer jack 2 is located at the reference position S, a racking operation can be performed.

The rear lower needle bed 1*b* (hereinafter referred to as "rear bed 1*b*") can be moved in a longitudinal direction thereof (hereinafter referred to as "racking") by a driving means (not shown).

The transfer jack bed on which the transfer jack 2 is mounted is controlled to move in a left and right direction so as to relatively move in a left and right direction with respect to the needle beds 1*a* and 1*b*. Therefore, the transfer jack 2 can transfer the stitch loop 6 between the front and rear lower needle beds 1*a* and 1*b* as well as among the transfer jack bed and the front and rear lower needle beds 1*a* and 1*b*.

The transfer jack 2 is provided with a relief portion 2*b* formed on a flat bottom portion 2*a* thereof, so as to avoid interference with a sinker plate 7 disposed on the needle beds 1*a* and 1*b*. A stitch loop hooking portion 8 is formed on an upper face of transfer jack 2 at a position biased by a distance D toward a base portion thereof from the reference position S (the center line X—X) when the transfer jack 2 is moved to the advanced position.

Forming the stitch loop hooking portion 8 at a position biased by the distance D toward the base portion of the transfer jack 2 as described above allows increasing an effective width F of a tip portion of the transfer jack 2 with respect to a width E of a hook portion 9 of the knitting needle 4*a* which is to enter into the stitch loop 6, compared with the effective width C (shown in FIG. 1) in the conventional case of forming the stitch loop hooking portion along the center line X—X (the reference position S).

On the other hand, a width G between the flat bottom portion 2*a* of the transfer jack 2 and a base portion side end portion of the stitch loop hooking portion 8, which a hook portion 10 of the knitting needle 4*b* entering into the stitch loop 6 from a direction of the tip portion of the transfer jack 2 is to confront, is reduced. However, since a height H of a side face erected from the base portion side end portion of the stitch loop hooking portion 8 (stitch loop stopper 13) is greater than the width E of the hook portion 10 of the knitting needle 4*b*, there is no inconvenience for the hook portion 10 of the knitting needle 4*b* in receiving the stitch loop 6 from the stitch loop hooking portion 8.

Next, an operation and a method of stitch transfer by the transfer jack 2 configured as above will be described.

Here, since a novel feature of the present invention lies in the working effect of the transfer jack 2 in transferring a stitch loop from the transfer jack 2 to the lower needle beds 1*a* and 1*b*, the present embodiment will describe a case of transferring the stitch loop from the front bed 1*a* or the rear bed 1*b* to the transfer jack bed 2, and again transferring back to the front bed 1*a* or the rear bed 1*b* after racking the transfer jack bed 2, in a lateral transfer of the stitch loop.

First, an example of a transfer of the stitch loop 6 hooked on the stitch loop hooking portion 8 of the transfer jack 2 to the knitting needle 4*a* of the front bed 1*a* (the knitting needle which enters from a direction of the base portion of the transfer jack) will be described.

As shown in FIG. 1 and FIG. 2(*a*), the transfer jack 2 is set at the reference position S with the stitch loop 6 hooked thereon, and the knitting needle 4*a* of the front bed 1*a* which is to receive the stitch loop 6 is in a stand-by state at a lowermost position, when starting the stitch transfer.

From such a state, the knitting needle 4*a* of the front bed 1*a* starts to move toward the stitch loop 6 hooked on the stitch loop hooking portion 8 of the transfer jack 2, as shown in FIGS. 2(*b*) and 2(*c*).

Figure 3:
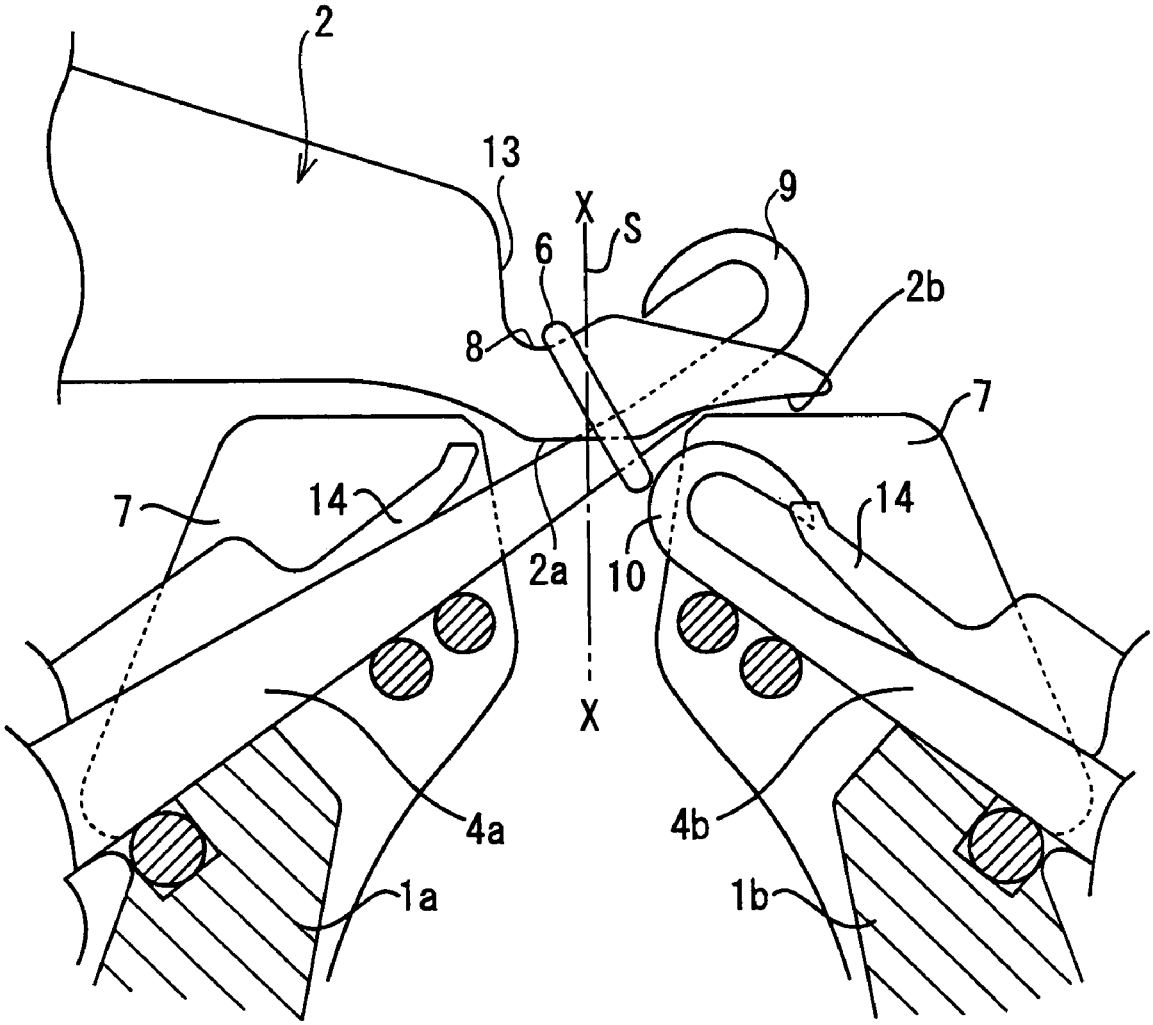
FIG. 3 is an enlarged fragmentary cross-sectional view showing a stitch transfer process by the transfer jack of Embodiment 1.
Figure 4A:
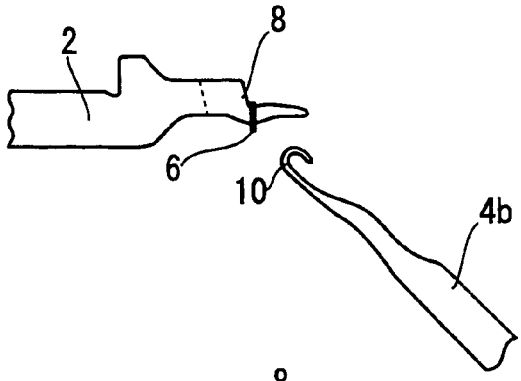
FIGS. 4(*a*) to 4(*e*) are schematic side views showing a stitch transfer process from the transfer jack of Embodiment 1 to a knitting needle of a rear needle bed.
Figure 4B:
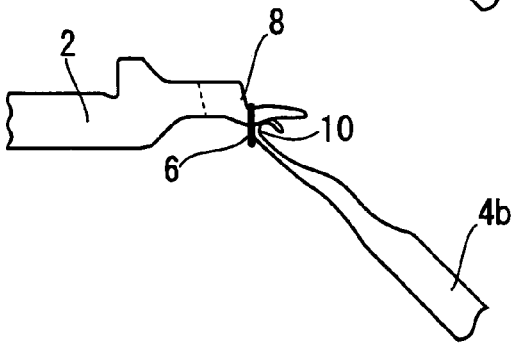
Figure 4C:
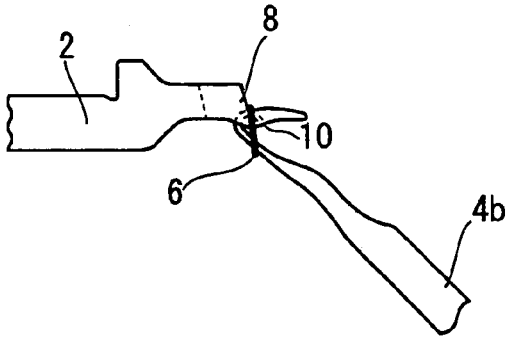
Figure 4D:
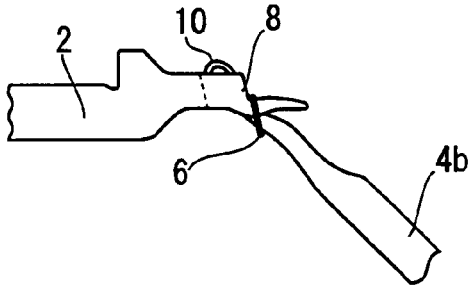
Figure 4E:
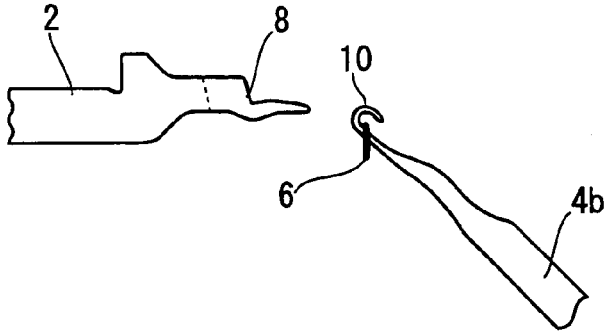

At this stage, since the stitch loop hooking portion 8 is located at a position biased by a distance D toward the base portion of the transfer jack 2 from the center X—X of the gap between the needle beds 1*a* and 1*b*, the effective width F of the tip portion of the transfer jack 2 is greater than the height E of the hook portion 9 of the knitting needle 4*a* which is to enter into the stitch loop 6. Therefore, the foregoing problem is minimized and the hook portion 9 of the knitting needle 4*a* can enter into the stitch loop 6 as illustrated (Ref. FIG. 2(*d*) and FIG. 3).

Accordingly, when a foremost portion of the hook portion 9 of the knitting needle 4*a* makes contact with a lower end portion of the stitch loop 6 hooked on the stitch loop hooking portion 8 by the forward movement of the knitting needle 4*a*, the lower portion of the stitch loop 6 moves toward the flat bottom portion 2*a* of the transfer jack 2, with an upper portion of the stitch loop 6 retained on the stitch loop hooking portion 8.

At this stage, a length of a line connecting a position where the upper portion of the stitch loop 6 is retained by the stitch loop hooking portion 8 and a position where the lower portion of the stitch loop 6 immediately proceeds the relief portion 2*b* from the flat bottom portion 2*a* corresponds to the effective width F of the transfer jack 2 with respect to the height E of the hook portion 9 of the knitting needle 4*a*.

Figure 10:
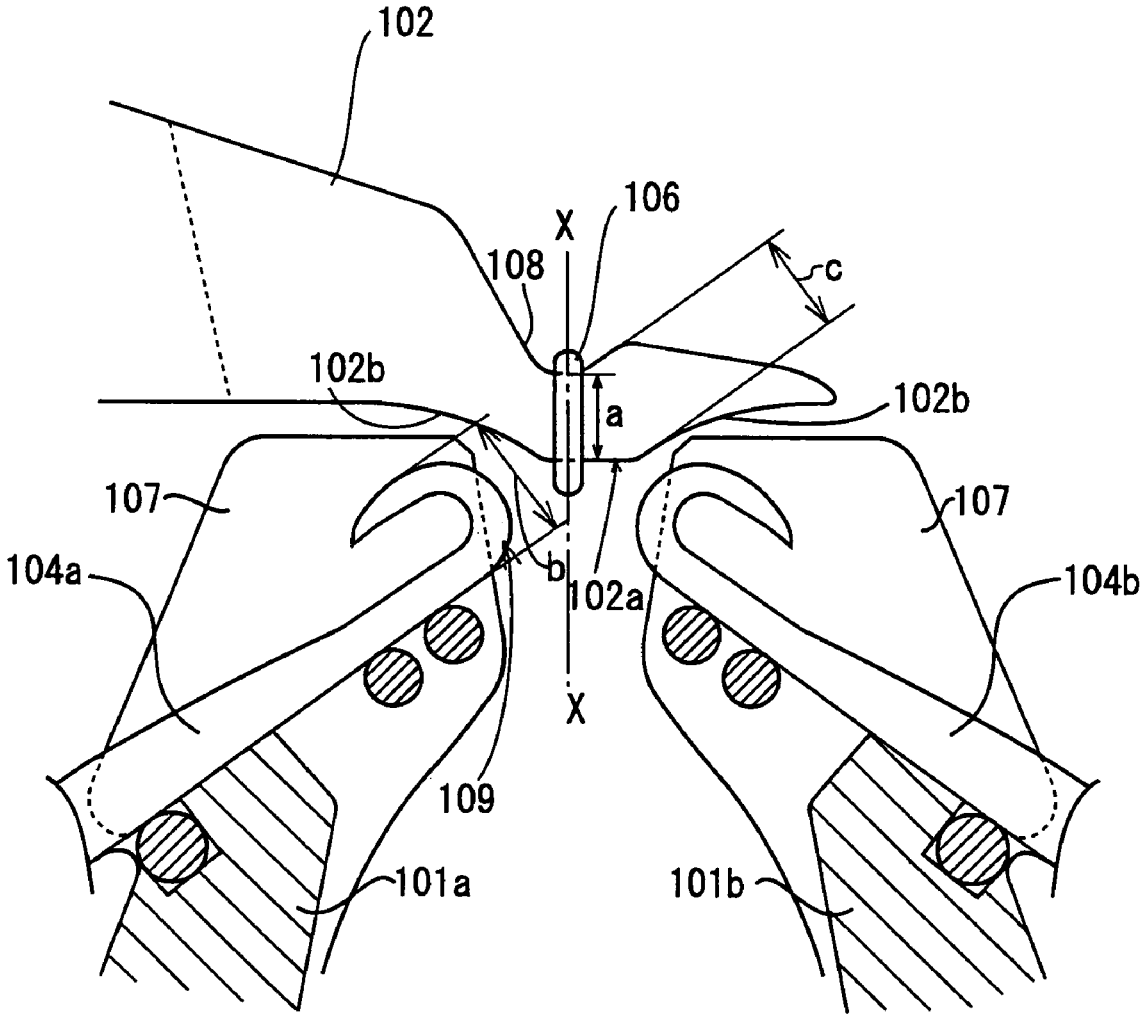
FIG. 10 is an enlarged fragmentary cross-sectional view showing a conventional transfer jack on which a stitch loop is hooked, in the proximity of a central portion of a trick gap.

Also, in the case where the stitch loop hooking portion is located on the center line X—X (the reference position S) as the prior art shown in FIG. 10, an effective width of the tip portion of the transfer jack 2 corresponds to the effective width c shown in FIG. 1.

Thereafter, when the transfer jack 2 starts to retreat as shown in FIG. 2(*e*) and the knitting needle 4*a* starts to descend, the stitch transfer from the transfer jack 2 to the knitting needle 4*a* of the front bed 1*a* is completed.

As described above, what is necessary is only to adopt a simple structure in which the position of the stitch loop hooking portion 8 is biased toward the base portion of the transfer jack 2 from a center between the front and rear needle beds 1*a* and 1*b* with respect to the advanced position. Therefore, it becomes much easier for the hook portion 9 of the knitting needle 4*a* to enter into the stitch loop 6 than in a conventional structure, and, furthermore, the transfer jack 2 can be easily worked and manufactured at a low cost.

Next, a stitch transfer from the transfer jack 2 to the confronting knitting needle 4*b* (the knitting needle entering from a direction of the tip portion of the transfer jack) of the rear bed 1*b* will be described.

As shown in FIG. 1 and FIG. 4(*a*), the transfer jack 2 is set at the reference position S with the stitch loop 6 hooked thereon, and the knitting needle 4*a* of the rear bed 1*b* which is to receive the stitch loop 6 is in a stand-by state at a lowermost position, when starting the stitch transfer from the transfer jack 2 to the knitting needle of the rear bed 1*b*.

From such a state, the knitting needle 4*b* of the rear bed 1*b* starts to move toward the stitch loop 6 hooked on the stitch loop hooking portion 8 of the transfer jack 2, as shown in FIGS. 4(*b*) and 4(*c*).

At this stage, since the stitch loop hooking portion 8 is located at a position biased by a distance D toward the base portion of the transfer jack 2 from the center X—X of the gap between the needle beds 1*a* and 1*b*, the height G from the stitch loop hooking portion 8 is lower than the height E of the hook portion 10 of the knitting needle 4*b*.

However, since the height H of the stitch loop stopper 13 extending in a backward direction (a direction of the base portion) from the stitch loop hooking portion 8 is greater than the height E of the hook portion 10 of the knitting needle 4*b*, the stitch loop 6 is kept from moving by the stitch loop stopper 13 though the knitting needle 6*b* pushes the stitch loop 6 toward the base portion of the transfer jack 2. Therefore, the hook portion 10 of the knitting needle 4*b* can enter into the stitch loop 6 (Ref. FIGS. 4(*d*) and 5).

Thereafter, when the transfer jack 2 starts to retreat as shown in FIG. 4(*e*) and the knitting needle 4*b* starts to descend, the stitch transfer from the transfer jack 2 to the knitting needle 4*b* of the rear bed 1*b* is completed.

Also, with the flat knitting machine according to this embodiment, what is necessary is only to adopt such a simple structure that the transfer jack 2 is arranged such that, when the transfer jack 2 is set at the advanced position, the position of the stitch loop hooking portion 8 is biased toward the base portion of the transfer jack 2 from the center line (X—X) between the front and rear needle beds with respect to the advanced position. Thus, it becomes much easier for the hook portion 9 of the knitting needle 4*a* to enter into the stitch loop 6 than in a conventional structure, and the transfer jack 2 can be easily worked and manufactured at a low cost.

EMBODIMENT 2

Figure 5:
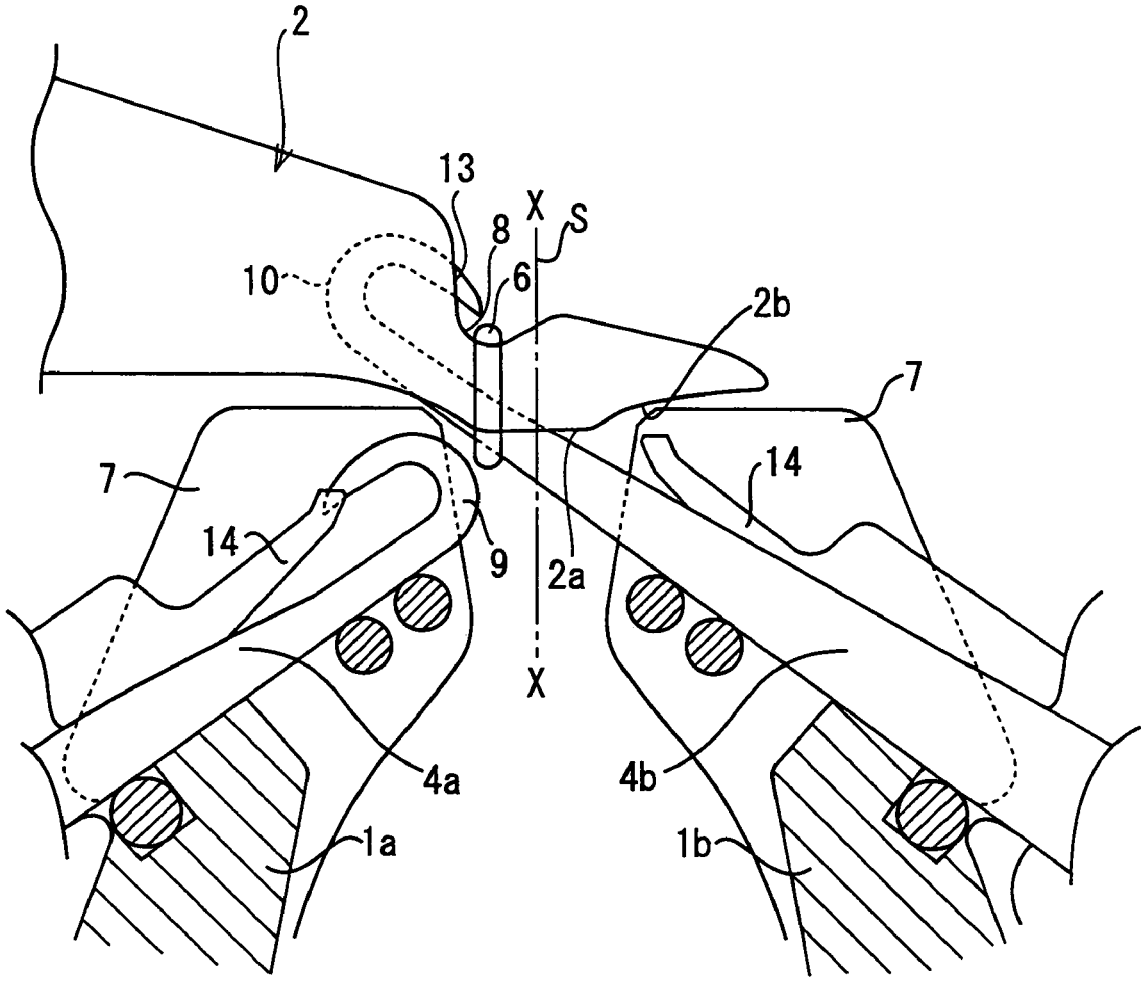
FIG. 5 is an enlarged fragmentary cross-sectional view showing a stitch transfer process by the transfer jack of Embodiment 1.
Figure 6:
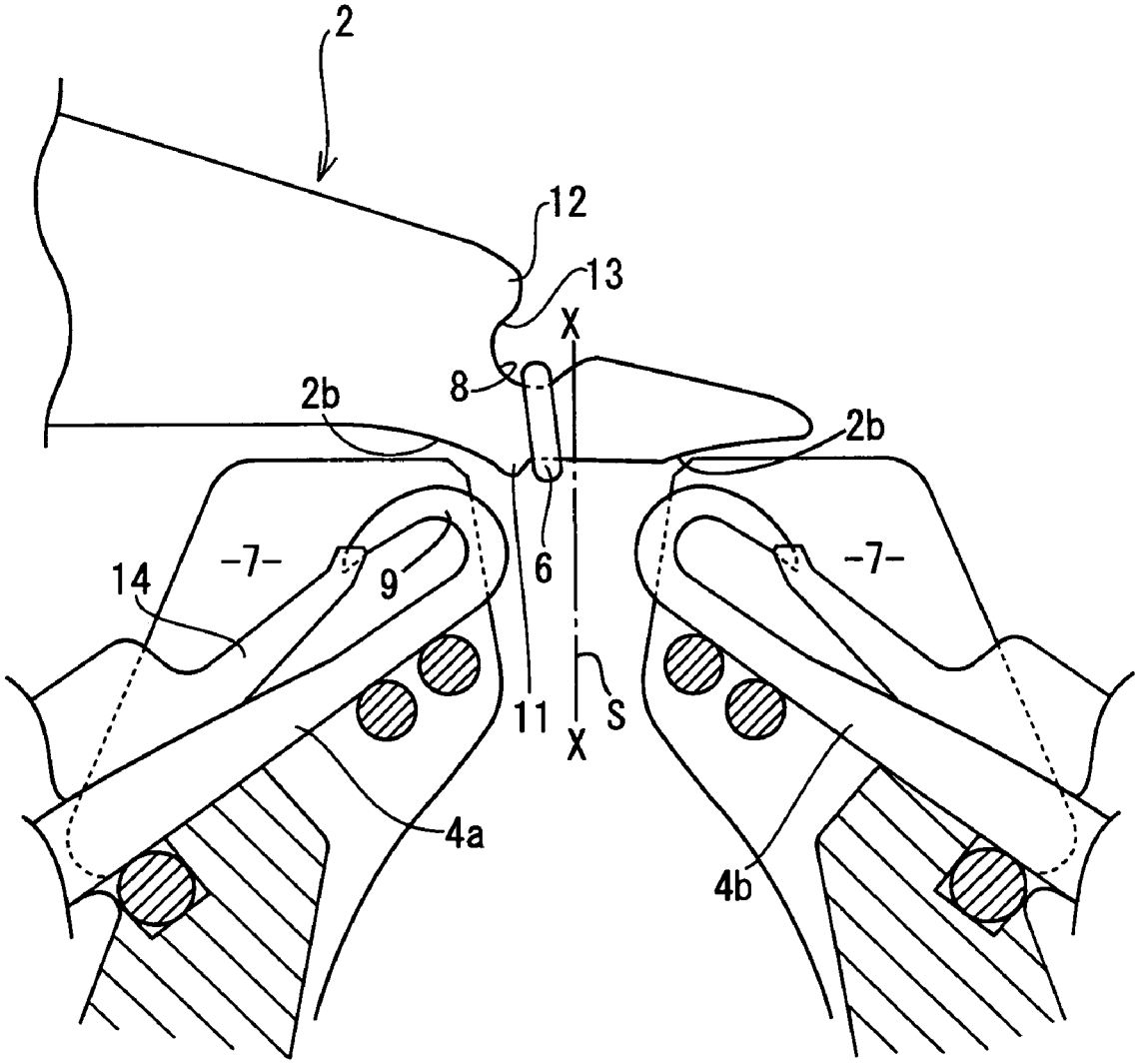
FIG. 6 is an enlarged fragmentary cross-sectional view showing a transfer jack according to Embodiment 2.
Figure 7:
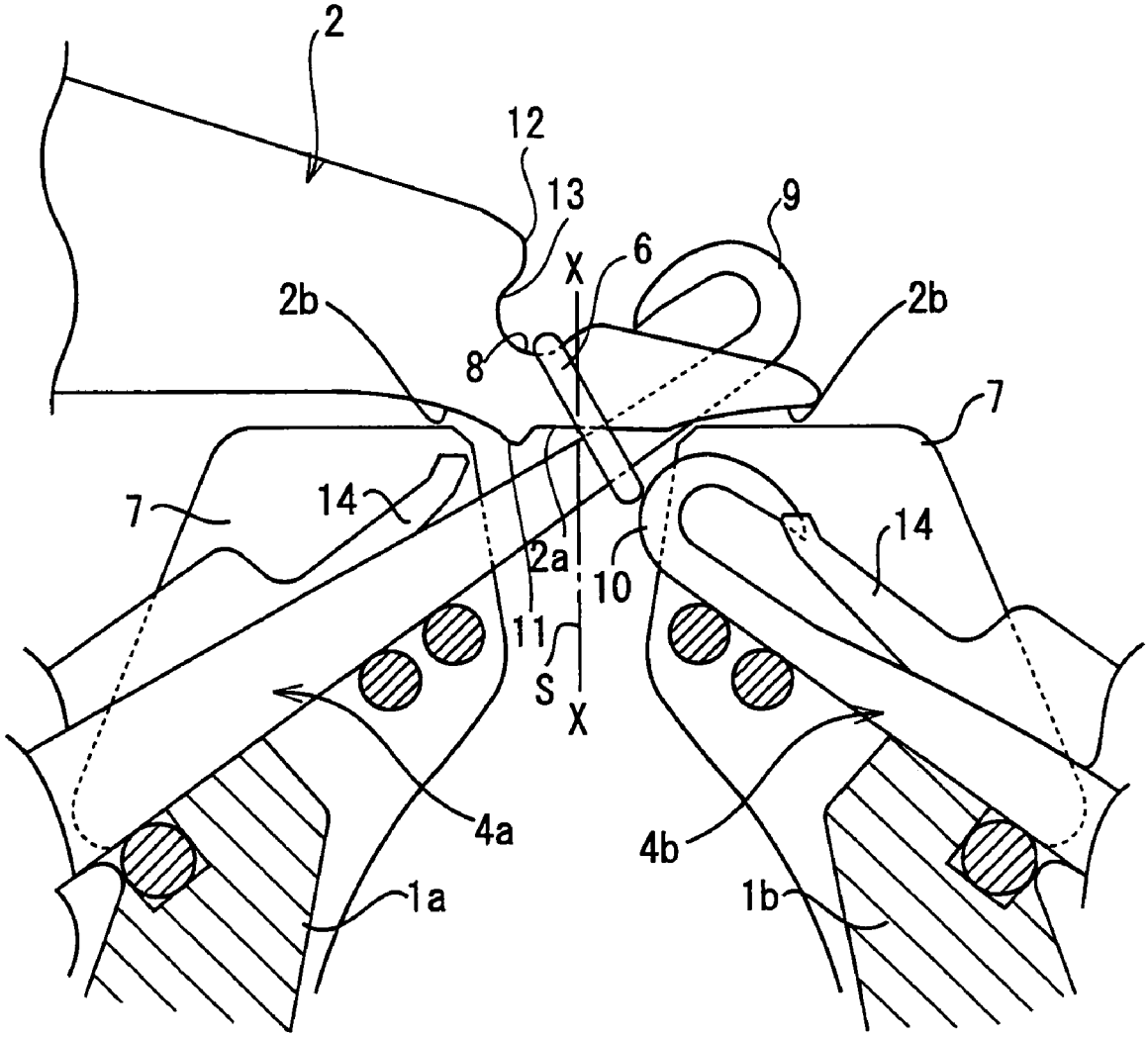
FIG. 7 is an enlarged fragmentary cross-sectional view showing a stitch transfer process from the transfer jack of Embodiment 2 to the knitting needle of the front needle bed.
Figure 8:
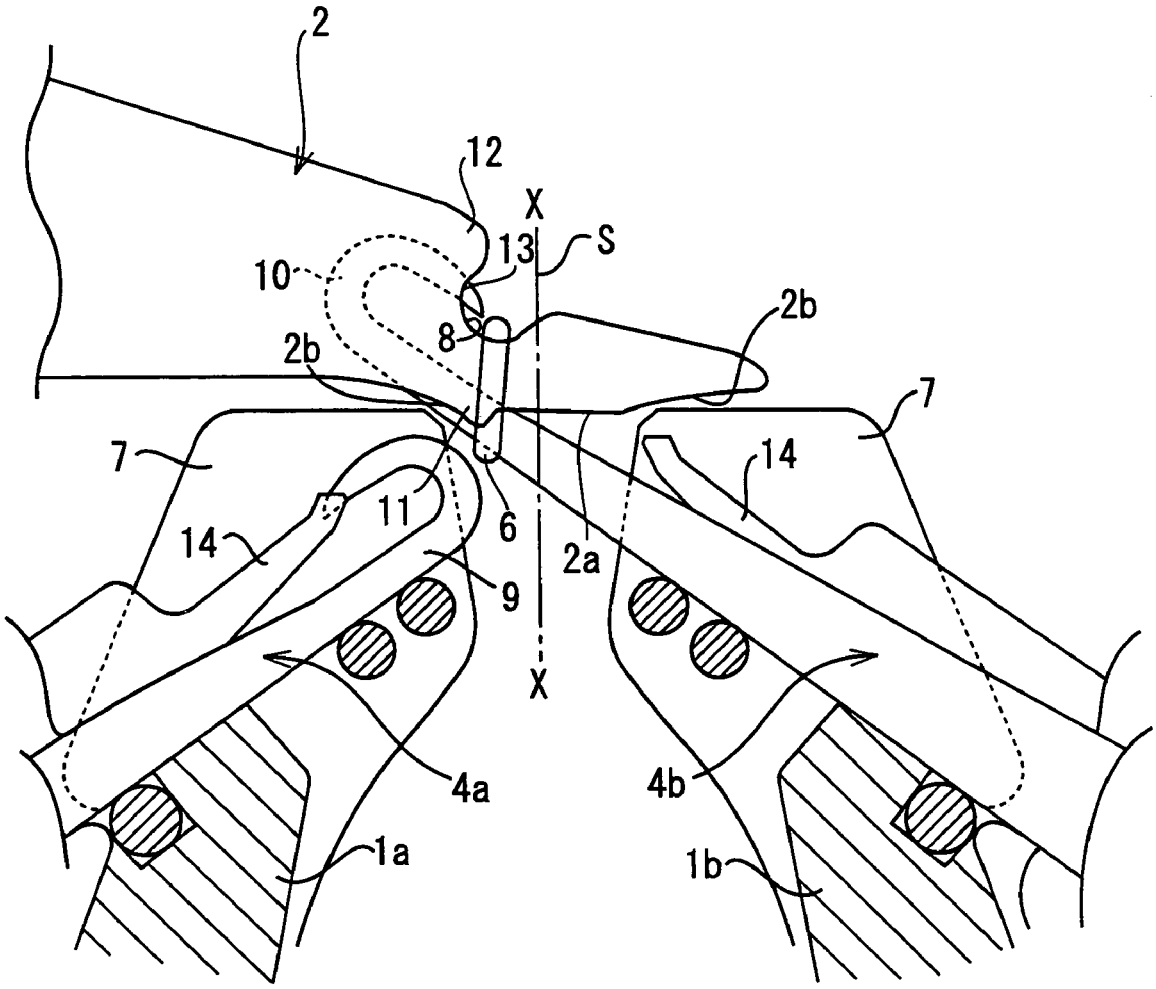
FIG. 8 is a schematic side view showing a stitch transfer process from the transfer jack of Embodiment 2 to the knitting needle of the rear needle bed.

A transfer jack according to Embodiment 2 will now be described. FIG. 6 to FIG. 9 show the transfer jack according to Embodiment 2, among which FIG. 6, FIG. 7, and FIG. 8 show a state corresponding to FIG. 1, FIG. 3, and FIG. 5 of Embodiment 1, respectively.

Figure 9:
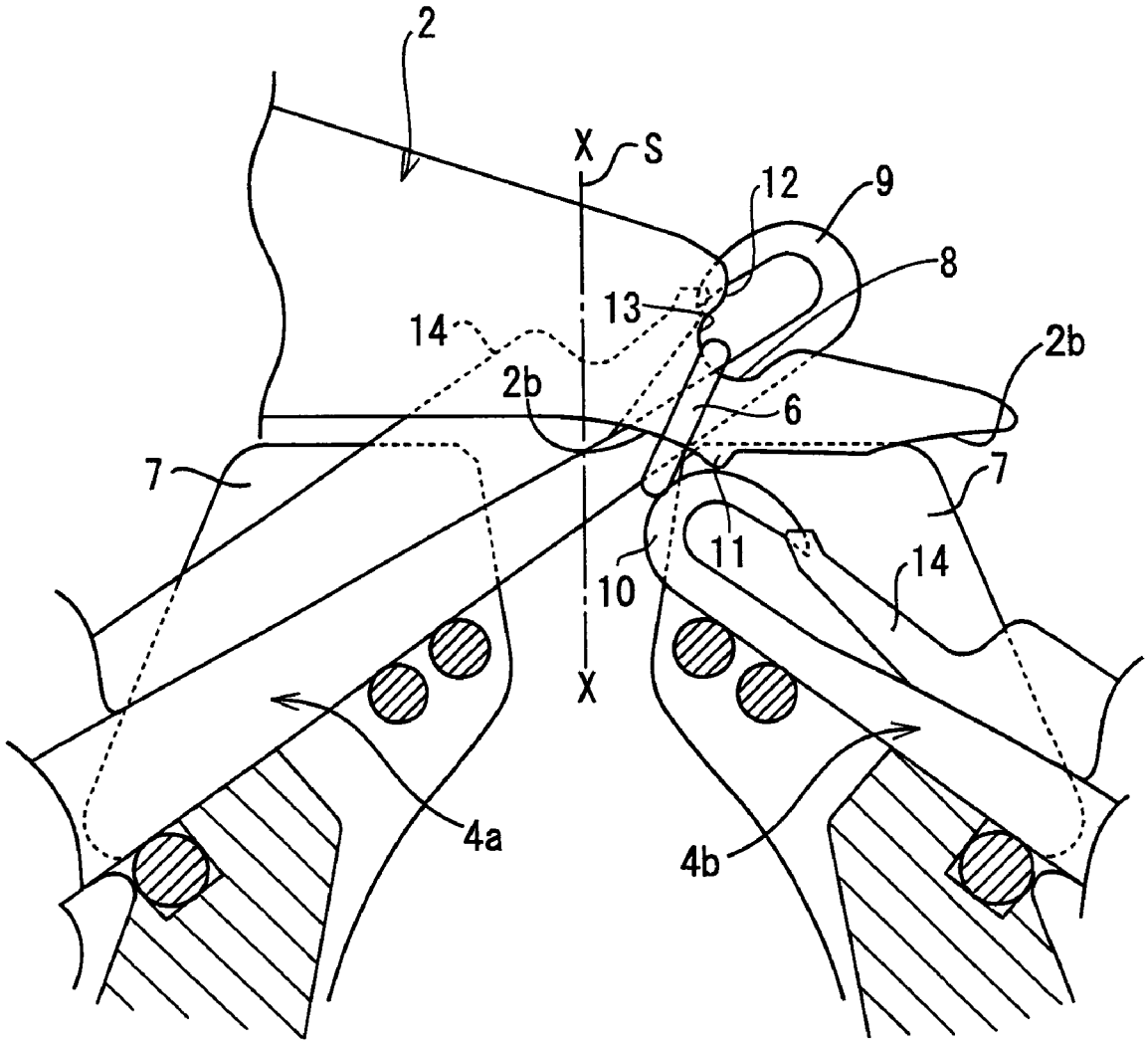
FIG. 9 is an enlarged fragmentary cross-sectional view showing a stitch transfer process by the transfer jack of Embodiment 2 to the knitting needle of the front needle bed.

Also, FIG. 9 shows an operation of a guide portion to be described later.

The transfer jack 2 according to Embodiment 2 is different from that of Embodiment 1 in that a stitch loop retaining portion 11 and a guide portion 12 are further provided, as shown in FIG. 6.

The stitch loop retaining portion 11 is a stepped portion formed on a lower face of the main body opposite to the stitch loop hooking portion 8, and serves to inhibit a movement of the stitch loop 6 so as to keep the stitch loop 6 hooked on the stitch loop hooking portion 8 from slipping toward the main body along the relief portion 2*b*.

The stitch loop 6 hooked on the stitch loop hooking portion 8 of the transfer jack 2 is prone to be caused to move by a tension applied there to when the transfer jack 2 horizontally moves with respect to the knitting needles 4*a* and 4*b* by a racking operation, and such movement is more frequently caused particularly when forming a tight stitch loop 6.

While the stitch loop retaining portion 11 in FIG. 6 is formed by leaving a portion unremoved when forming the relief portion on a lower face of the main body of the transfer jack 2 of Embodiment 1, any other form may be adopted as long as a movement of the stitch loop 6 can be prevented. For example the stitch loop retaining portion can be formed by cladding on a lower face of the main body of Embodiment 1.

It is preferable that the stitch loop retaining portion 11 is provided when transferring the stitch loop 6 from the transfer jack 2 to the knitting needle 4*a* of the needle bed 1*a* located directly thereunder (especially, for retaining the stitch loop 6 at a predetermined position when the hook portion 9 of the knitting needle 4*a* enters into the stitch loop 6), and thereby guiding the hook portion 9 of the knitting needle 4*a* inside the stitch loop 6.

More specifically, the stitch loop retaining portion 11 retains a lower end portion of the stitch loop 6 in an area from a center in a direction of a height of the hook portion 9 to a rear face of the hook portion 9 within a travel stroke of the hook portion 9. Thus, the hook portion 9 moves the lower end portion of the stitch loop 6 toward a rear face of the hook, to thereby enter into the stitch loop 6.

With reference to the guide portion 12, the guide portion 12 is formed so as to protrude from a portion of the stitch loop stopper 13 toward the gap between the front and rear needle beds 1*a* and 1*b*.

When transferring the stitch loop 6 from the transfer jack 2 to the knitting needle 4*a* of the front needle bed 1*a* located directly thereunder, the knitting needle 4*a* is first moved forward such that the hook portion 9 enters into the stitch loop 6 as shown in FIG. 7. Then, the transfer jack 2 is moved farther forward over the reference position S so as to push the stitch loop 6 hooked on the stitch loop hooking portion 8 inside the hook portion 9 of the knitting needle 4*a* as shown in FIG. 9, in which state a slider 14 is lifted so as to close the hook portion 9.

Thereafter, the transfer jack 2 is moved backward so that the stitch loop 6 is transferred to the knitting needle 4*a*.

Likewise, the stitch transfer from the transfer jack to the knitting needle 4*b* of the rear needle bed 1*b* can also be executed in a similar manner as shown in FIG. 8.

Since a method of such a stitch transfer is described in detail in the IP Laid Open WO02/16684 (Title of the Invention: Flat knitting machine provided with stitch transfer mechanism and method of stitch transfer), this document is incorporated hereinto by reference, and description thereof will be omitted.

However, in the case where the stitch loop is constituted of a plurality of knitting yarns or is loosely formed, the knitting yarn constituting the stitch loop 6 may float above the stitch loop hooking portion 8. Also, when moving the transfer jack 2 farther forward over the reference position S so as to push the stitch loop 6 inside the hook portion 10, the stitch loop 6 may float along the stitch loop stopper 13. Therefore, the stitch loop 6 may not always be in contact with the stitch loop hooking portion 8.

Even in such a case, the guide portion 12 can suppress a floating motion of the stitch loop 6, to thereby allow the hook portion 10 to close with the stitch loop 6 duly caught inside the hook portion 10.

While the guide portion 12 is formed such that an upper portion in a side view of the stitch loop stopper 13 extending from the stitch loop hooking portion 8 is protruding so as to overhang toward the center line X—X of a gap between the needle beds 1*a* and 1*b* in this embodiment, any other form may be adopted as long as the stitch loop 6 can be prevented from floating.

Also, the guide portion 12 offers a similar advantage with a latch needle, without limitation to the compound needle constituted of the slider 14 and a needle main body.

Further, the transfer jack 2 of this embodiment has been described referring to the case where, since the stitch loop hooking portion 8 is biased toward the base portion of the transfer jack from the center line X—X of the gap between the needle beds 1*a* and 1*b*, by which the effective width of the tip portion of the transfer jack is increased with respect to the height of the hook portion of the knitting needle, the position of the transfer jack during the racking operation is defined as the reference position instead of moving the transfer jack horizontally or vertically when moving forward the hook portion of the knitting needle into the stitch loop. Therefore, the hook portion of the knitting needle enters into the stitch loop hooked on the stitch loop hooking portion of the transfer jack located in such a reference position, as disclosed in the foregoing Japanese Published Unexamined Patent Application No. H11-323703 and IP Laid Open WO01/86048. However, it is a matter of course that the methods described in these patented documents may be freely employed in combination for performing the stitch transfer, as the case may be.

Also, in doing so, in the case where a position of the transfer jack when the hook portion of the knitting needle enters into the stitch loop is farther forward than the reference position, it is preferable to form the stitch loop retaining portion at such a position that a lower end portion of the stitch loop can be retained in an area from a center in a direction of a height of the hook portion to a rear face of the hook portion within a travel stroke of the hook portion.

As described above, according to the present invention, since the stitch loop hooking portion of the transfer jack is formed in a position biased toward the base portion of the transfer jack from the center of the gap between the needle beds, the effective width F of the tip portion of the transfer jack is not reduced with respect to the width E of the hook portion of the knitting needle which is to enter into the stitch loop in a direction from the base portion of the transfer jack toward the tip portion thereof, but a sufficient width can be secured.

Also, a movement of the stitch loop caused by the knitting needle entering into the stitch loop in a direction from the tip portion of the transfer jack toward the base portion thereof can be inhibited by the stitch loop stopper backwardly extending from the stitch loop hooking portion.

Consequently, when transferring the stitch loop from the transfer jack to the knitting needle located thereunder, the stitch loop can be easily transferred without being pushed by the hook portion of the knitting needle moving forward to thereby be kept from becoming engaged with the hook portion or without falling off.

The invention claimed is:

1. A transfer jack comprising:

a main body having:

a tip portion with an upper face and a lower face;

a stitch loop hooking portion for engaging a stitch loop, said stitch loop hooking portion being formed on said upper face of said tip portion;

a stitch loop stopper backwardly extending from said stitch loop hooking portion; and a pair of relief portions on said lower face of said tip portion of said main body in the proximity of said stitch loop hooking portion, said pair of relief portions being shaped and arranged to avoid interference between said transfer jack and a sinker plate at a foremost portion of a front needle bed and a rear needle bed during a racking motion and when said transfer jack is located at an advanced position;

wherein said stitch loop hooking portion is shaped so as to be biased toward a base end of said main body from a center of a gap between the front needle bed and the rear needle bed when said transfer jack is located at the advanced position during the racking motion, and wherein a flat bottom portion between said pair of relief portions on said lower face of said transfer jack is located in the gap between the front needle bed and the rear needle bed when said transfer jack is located at the advanced position during the racking motion so that interference with the sinker plate can be avoided, whereby an effective width corresponding to a distance between said stitch loop hooking portion and a tip portion of each of said relief portions of said transfer jack is increased with respect to a height of a hook portion of a knitting needle when the knitting needle enters into the stitch loop from a base end-side of said main body of said transfer jack.

2. The transfer jack of claim 1, wherein said main body further has a stitch loop retaining portion on said lower face of said tip portion opposite said stitch loop hooking portion, said stitch loop retaining portion being shaped and arranged to keep the stitch loop from moving so as to prevent the stitch loop hooked on said stitch loop hooking portion from slipping toward said base end.

3. A flat knitting machine comprising said transfer jack of claim 2.

4. The transfer jack of claim 1, wherein said stitch loop stopper includes a guide portion projecting toward the gap between the front needle bed and the rear needle bed so as to facilitate catching of the stitch loop by the hook portion of the knitting needle when the stitch loop is transferred from said transfer jack to the knitting needle.

5. A flat knitting machine comprising said transfer jack of claim 4.

6. A flat knitting machine comprising said transfer jack of claim 1.

7. A method of stitch transfer utilizing a transfer jack including a main body having a tip portion with an upper face and a lower face, a stitch loop hooking portion on the upper face of the tip portion, a stitch loop stopper backwardly extending from the stitch loop hooking portion, and a pair of relief portions on the lower face of the tip portion in the proximity of the stitch loop hooking portion for avoiding interference between the transfer jack and a sinker plate at a foremost portion of a front needle bed and a rear needle bed during a racking motion and when the transfer jack is located at an advanced position, wherein the stitch loop hooking portion is shaped so as to be biased toward a base end of the main body from a center of a gap between the front needle bed and the rear needle bed when the transfer jack is located at the advanced position during the racking motion, and wherein a flat bottom portion between the pair of relief portions on the lower face of the transfer jack is located in the gap between the front needle bed and the rear needle bed when the transfer jack is located at the advanced position during the racking motion so that interference with the sinker plate can be avoided, whereby an effective width corresponding to a distance between the stitch loop hooking portion and a tip portion of the relief portion of the transfer jack is increased with respect to a height of a hook portion of a knitting needle, said method comprising:

hooking the stitch loop on the stitch loop hooking portion from a knitting needle on one of the front needle bed and the rear needle bed while the transfer jack is located at the racking position;

when the knitting needle is to enter into the stitch loop from a direction of the base end of the main body of the transfer jack, allowing the hook portion of the knitting needle to enter into the stitch loop via the increased effective width;

stopping a movement of the stitch loop caused by the advancing knitting needle using the stitch loop stopper when the knitting needle enters into the stitch loop from a direction of a tip end of the main body of the transfer jack; and passing the knitting needle through the stitch loop so as to engage the stitch loop with the hook portion of the knitting needle.

* * * * *